United States Patent [19]

Fisher

[11] 4,306,671

[45] Dec. 22, 1981

[54] PORTABLE MOTOR DRIVEN DISPENSER

[76] Inventor: Arnold J. Fisher, 1332 McKinley, Alamagordo, N. Mex. 88310

[21] Appl. No.: 135,675

[22] Filed: Mar. 31, 1980

[51] Int. Cl.[3] ..... B67D 5/46

[52] U.S. Cl. ..... 222/326; 222/333; 222/390

[58] Field of Search ..... 222/325–327, 222/333, 390; 74/606 R; 308/75

[56] References Cited

U.S. PATENT DOCUMENTS

| | | | |
|---|---|---|---|
| Re. 26,180 | 4/1967 | Frenzel et al. | 222/327 X |
| 1,288,562 | 12/1918 | Graf | 308/75 X |
| 3,635,378 | 1/1972 | DeHart | 222/326 X |
| 3,854,629 | 12/1974 | Blieberger | 222/333 X |
| 3,888,134 | 6/1975 | Miranda | 74/606 R |

FOREIGN PATENT DOCUMENTS

| | | | |
|---|---|---|---|
| 724269 | 4/1932 | France | 74/606 |

*Primary Examiner*—Charles A. Marmor

[57] ABSTRACT

A motor driven dispenser for extruding viscous material from a cartridge is disclosed in which a cartridge tray and a reversible, motor driven cartridge plunger are mounted on a centrally hinged gear case which contains a pair of gears for transmitting motive power between a motor and the plunger.

8 Claims, 3 Drawing Figures

PORTABLE MOTOR DRIVEN DISPENSER

BACKGROUND OF THE INVENTION

1. Field of the Invention

This invention relates to hand held portable dispensing devices such as caulking tools and pertains in particular to those which are power driven.

2. Description of the Prior Art

Caulking tools of the type to which this invention pertains dispense a viscous caulking material from a cartridge. Such devices are widely used and cartridges can be readily purchased at a variety of commercial outlets. Typically, the cartridge is held in a tray and a plunger or ram is pressed against the end of the cartridge so as to squeeze out material encapsulated therein.

Such devices have found wide use in a number of applications. Most, however, must be manually operated. A few types are available with a motor drive but they are generally cumbersome, inconvenient to use and costly.

Accordingly, an object of this invention is to achieve a power driven device for dispensing a viscous material which is convenient, easy to use and available at low cost.

Another object of this invention is to achieve a power driven device which is simple and easy to manufacture.

Still another object of this invention is to achieve a device which can be operated by power tools found generally in the home.

SUMMARY OF THE INVENTION

In accordance with a preferred embodiment of this invention, a driven threaded rod for actuating a cartridge is combined with a driving gear assembly, a cartridge tray and a gear housing assembly to obtain a simple and easy to use device for dispensing a viscous material.

In accordance with one feature of this invention, manufacturing is simplified by mounting two coextensive rod holding bearings in the housing so that the gear assembly is bracketed between the two.

In accordance with another feature of this invention, the housing is hinged and the bearings are split with one part of each affixed to the hinged portion of the housing so that the rod can readily be reversed end for end when the housing is opened.

A better understanding of these and other objects and features of the invention will be facilitated by reference to the following drawing and detailed description.

DETAILED DESCRIPTION

Figure 1:
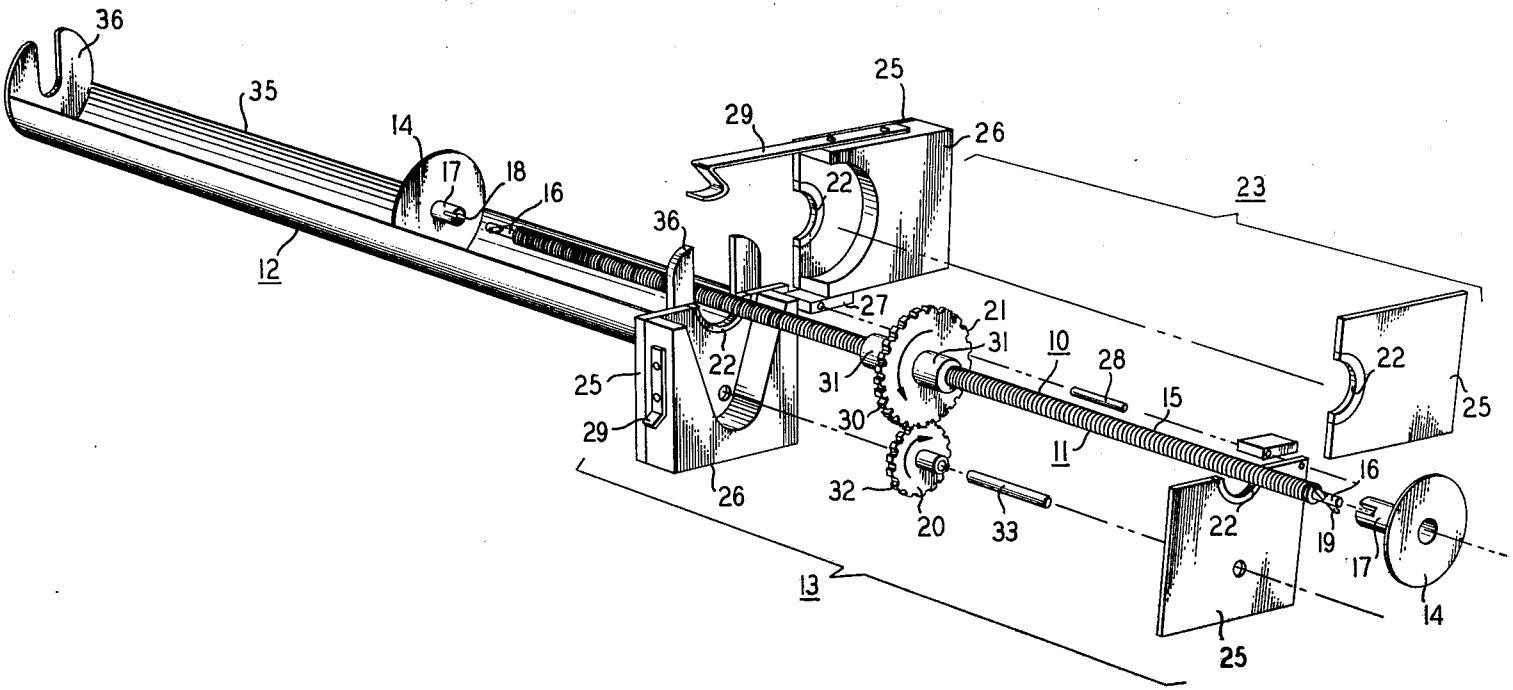
FIG. 1 is an exploded view taken in perspective of a device for dispensing a viscous material made in accordance with this invention.
Figure 2:
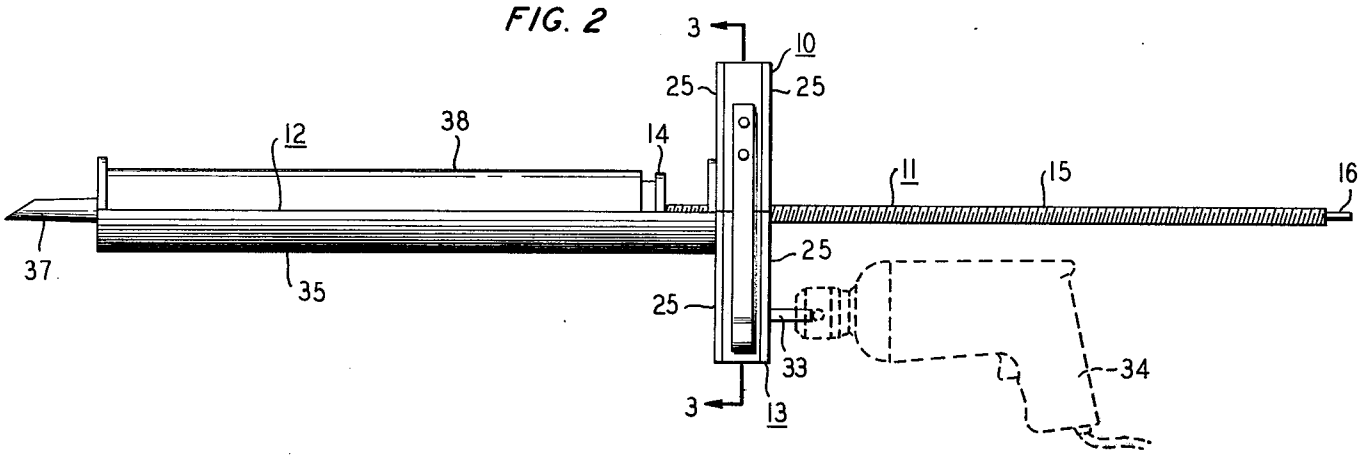
FIG. 2 is a side elevation view of the device depicted in FIG. 1.

Referring to FIGS. 1 and 2, a dispenser 10 is disclosed which comprises a plunger assembly 11, cartridge holding assembly 12 and a gear assembly 13. As best seen in FIG. 1, the plunger assembly 11 comprises at least one pressure pad 14 and an elongated threaded rod 15 which terminates in two hubs 16. The pressure pad 14 is adapted to mount on either end of the rod 15 and engage the end of a cartridge. Advantageously, each pressure pad 14 includes a shoulder 17 having a drilled and slotted opening 18 adapted to accept a hub 16 in the open portion and, if desired, a pin 19 in the slotted portion.

Figure 3:
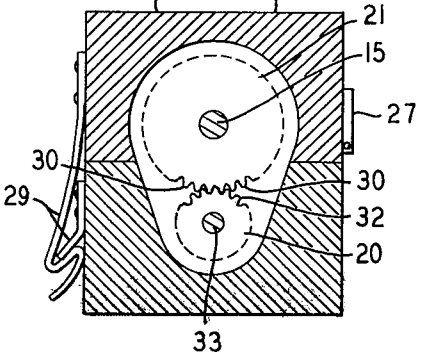
FIG. 3 is an end elevation view of the device shown in FIG. 2 taken in section along the line 3—3.

The gear assembly 13 comprises, as best seen in FIGS. 1 and 3, a driving gear 20, a driven gear 21, two split bearings 22 and a housing assembly 23 for holding the two gears in place between the bearings 22. The housing assembly 23 comprises two side plates 25 which hold the split bearings 22, a relieved center block 26 sandwiched between the side plates 25, a hinge block 27, a hinge pin 28 and a latch unit 29. The two side plates 25 and the center block 26 are split in half and joined to the hinge block 27 at one end and the latch unit 29 at the other end to form a hinged case. The driving gear 20 and the driven gear 21 fit in the relieved portion of the center block 26.

The driven gear 21 includes external teeth 30 and an internally threaded hub 31. As best seen in FIGS. 1 and 3, the hub 31 surrounds the rod 15 so that the threads on each engage to impart longitudinal movement between the two when one or the other is rotated. In addition, the hub 31 is embraced by the split bearings 22 and held stationary in the longitudinal direction of the long axis of the rod 15 by the end plates 25. Similarly, the drive gear 20 includes external teeth 32 and a shaft 33 which extends beyond the side plates 25 as illustrated in FIG. 2. The shaft 33 is free to rotate in the end plates 25, but is keyed or press fit in the driving gear 20. Moreover, the end of the shaft 33 is adapted to fit the chuck of a power tool as, for example, one such as the power drill 34 shown in phantom in FIG. 2.

As best seen in FIG. 3, the teeth 30 and the teeth 32 mesh so that rotational movement imparted through the shaft 33 will manifest itself as longitudinal movement of the rod 15.

The cartridge housing assembly 12 includes a semicylindrical tray 35 with slotted ends 36 adapted to accept the rod 15 and a spout 37 on a cartridge 38 as shown in FIG. 2.

In operation, as best seen in FIG. 1, the case assembly 22 is opened and the rod 15 with gear 21 inserted so that the driven gear 21 is held in the split bearings 22 to engage the teeth of gear 20 and the pressure pad 14 engages the end of a cartridge 38 with sufficient force to resist rotation. Thereafter, the drill 34 is activated to screw the rod 15 through the driven gear 21 so as to press against the end of the cartridge 13 and thereby extrude the encapsulated material out through the spout 37.

When the cartridge 38 is emptied, it is disposed of and replaced with another. It will be noted, however, that the rod 15 need not be unthreaded for the next operation. Instead, it is merely reversed end for end in the housing assembly 22 and is then ready for the next operation.

In summary, an improved power driven device for extruding a viscous material has been disclosed which is simple to make and which is simple and easy to use with generally available power activated tools. While only one embodiment of the invention has been disclosed, it is exemplary of the principles of the invention and it is anticipated that others skilled in the art will readily conceive of other embodiments falling within the scope of the invention.

What I claim is:

1. In a device for dispensing viscous material from a cartridge, the combination comprising:

elongated threaded rod means for pressing one end of a cartridge so as to force material encapsulated therein out of the other end;

tray means for holding said cartridge in coextensive relationship to said rod;

drive gear means having shaft means adapted to rotate said drive gear means when said shaft means is rotated;

hub gear means surrounding said rod and having internal threads engaging the threads thereon so as to impart translational movement thereto when said hub gear means is rotated and external tooth means engaging said drive gear means so as to transmit rotational movement from said drive gear means to said hub gear means, and;

housing means for supporting said rod means, tray means, drive gear means, and hub gear means, said housing means including a hinged cap and two coextensive split bearings adapted to retain said rod means so as to prohibit translational movement of said hub gear means while simultaneously permitting translational movement of said rod means, half of each of said bearings being affixed to the hinged portion of said cap so that said rod means can be removed and reversed end for end when said cap is opened.

2. The combination in accordance with claim 1 wherein said rod means has at least one pressure pad adapted to engage the end of a cartridge.

3. The combination in accordance with claim 2 wherein said pressure pad is interchangeable with each end of said rod.

4. The combination in accordance with claim 1 wherein said bearings are supported by two parallel plates, said shaft means extends between said two plates to suspend said drive gear means there between and at least one end of said shaft means projects through and beyond its supporting plate.

5. The combination in accordance with claim 4 wherein said one end of said shaft means is adapted to engage the chuck of a power driven device.

6. The combination in accordance with claim 5 wherein said power driven device is an electric power drill.

7. In a device for dispensing viscous materials from a cartridge, the combination comprising:

plunger means for pressing one end of a cartridge so as to extrude encapsulated material out of the other end, said plunger means including an elongated threaded rod, an externally toothed driven gear having peripheral driven teeth and internal threads driveably engaging threads on said rod and at least one end pad adapted to engage said one end of a cartridge and adapted to removeably mount on either end of said rod;

cartridge holding means for supporting a cartridge in coextensive alignment with said end pad, and gear housing means for supporting said plunger means and cartridge holding means and for holding said driven gear stationary with respect to axial movement of said rod, said gear housing means being centrally hinged to permit end for end reversal of said driven gear and including a driving gear having external driving teeth and a shaft, said driving teeth being engageable with the driven teeth on said driven gear and said shaft being adapted to fit the chuck of an external motor so as to transmit motor force from said motor to said driven gear.

8. The combination in accordance with claim 7 wherein said external motor comprises an electric drill.

* * * * *